US009319810B2

(12) United States Patent
Leigh et al.

(10) Patent No.: US 9,319,810 B2
(45) Date of Patent: Apr. 19, 2016

(54) IMPLANTABLE COMPONENT OF A HEARING PROSTHESIS

(75) Inventors: C. Roger Leigh, East Ryde (AU); Wim Bervoets, Wilrijk (BE); Erik Holgersson, Gothenburg (SE); Marcus Andersson, Goteborg (SE); Bart Carpentier, Mechelen (BE)

(73) Assignee: Cochlear Limited, Macquarie University, NSW (AU)

( * ) Notice: Subject to any disclaimer, the term of this patent is extended or adjusted under 35 U.S.C. 154(b) by 906 days.

(21) Appl. No.: 13/313,938

(22) Filed: Dec. 7, 2011

(65) Prior Publication Data

US 2013/0150657 A1 Jun. 13, 2013

(51) Int. Cl.
*H04R 25/00* (2006.01)

(52) U.S. Cl.
CPC ..... *H04R 25/606* (2013.01)

(58) Field of Classification Search
CPC .... H04R 25/606; H04R 25/00; H04R 25/554; H04R 25/604; H04R 2460/13; H04R 2225/67; A61N 1/36032; A61N 1/375; A61N 1/0541
USPC ..... 381/151, 326; 600/25
See application file for complete search history.

(56) References Cited

U.S. PATENT DOCUMENTS

| | | | | |
|---|---|---|---|---|
| 4,612,915 | A | 9/1986 | Hough et al. | |
| 2003/0229262 | A1 * | 12/2003 | Easter et al. | 600/25 |
| 2004/0032962 | A1 | 2/2004 | Westerkull | |
| 2006/0045298 | A1 * | 3/2006 | Westerkull | 381/326 |
| 2011/0144415 | A1 * | 6/2011 | Hellmuth et al. | 600/25 |

* cited by examiner

*Primary Examiner* — Christine H Matthews
(74) *Attorney, Agent, or Firm* — Hauptman Ham, LLP

(57) ABSTRACT

A hearing prosthesis including an implantable component including a vibrator portion configured to vibrate in response to a sound signal to evoke a hearing precept and a screw portion configured to removably attach the implantable component to a recipient, wherein the vibratory portion is rigidly adhered to the screw portion.

27 Claims, 12 Drawing Sheets

IMPLANTABLE COMPONENT OF A HEARING PROSTHESIS

BACKGROUND

1. Field of the Invention

The present invention relates generally to hearing prostheses, and more particularly, to implantable components of a hearing prosthesis.

2. Related Art

Hearing loss, which may be due to many different causes, is generally of two types: conductive and sensorineural. Sensorineural hearing loss is due to the absence or destruction of the hair cells in the cochlea that transduce sound signals into nerve impulses. Various hearing prostheses are commercially available to provide individuals suffering from sensorineural hearing loss with the ability to perceive sound. For example, cochlear implants use an electrode array implanted in the cochlea of a recipient to bypass the mechanisms of the ear. More specifically, an electrical stimulus is provided via the electrode array to the auditory nerve, thereby causing a hearing percept.

Conductive hearing loss occurs when the normal mechanical pathways that provide sound to hair cells in the cochlea are impeded, for example, by damage to the ossicular chain or ear canal. Individuals suffering from conductive hearing loss may retain some form of residual hearing because the hair cells in the cochlea may remain undamaged.

Individuals suffering from conductive hearing loss typically receive an acoustic hearing aid. Hearing aids rely on principles of air conduction to transmit acoustic signals to the cochlea. In particular, a hearing aid typically uses a component positioned in the recipient's ear canal or on the outer ear to amplify a sound received by the outer ear of the recipient. This amplified sound reaches the cochlea causing motion of the perilymph and stimulation of the auditory nerve.

In contrast to hearing aids, certain types of hearing prostheses commonly referred to as bone conduction devices, convert a received sound into mechanical vibrations. The vibrations are transferred through the skull to the cochlea causing generation of nerve impulses, which result in the perception of the received sound. Bone conduction devices may be a suitable alternative for individuals who cannot derive sufficient benefit from acoustic hearing aids.

SUMMARY

In one aspect of the invention, there is a hearing prosthesis, comprising an implantable component including a vibrator configured to vibrate in response to a sound signal and a coupling portion configured to removably attach the implantable component to a recipient of the hearing prosthesis, wherein the vibratory portion is rigidly adhered to the coupling portion.

In another aspect of the present invention, there is a hearing prosthesis comprising a vibrational element, and a housing containing the vibrational element, the housing including an integral vibration isolator.

In another aspect of the present invention, there is a method, the method comprising generating vibrational energy indicative of a sound signal with a hearing prosthesis, conducting the vibrational energy to a recipient of the hearing prosthesis via a vibrational path through the hearing prosthesis, and minimizing conduction of the vibrational energy to the recipient via another vibrational path through the hearing prosthesis.

BRIEF DESCRIPTION OF THE DRAWINGS

Embodiments of the present invention are described below with reference to the attached drawings, in which.

DETAILED DESCRIPTION

Some aspects of the present invention are generally directed to bone conduction devices configured to deliver mechanical vibrations to a recipient's cochlea via the skull to cause a hearing percept. The implantable component of a transcutaneous bone conduction device includes a vibrator portion, such as an implantable plate in the case of a passive transcutaneous bone conduction device, or an implantable vibrating actuator and housing in the case of an active transcutaneous bone conduction device, configured to vibrate in response to a sound signal to evoke a hearing precept. The implantable component also includes a screw portion configured to attach the implantable component to a recipient. The vibratory portion is rigidly adhered to the screw portion such that there are no gaps or seams between the housing and the screw portion in which bacteria may be contained/in which a biofilm may develop at levels greater than about levels of other portions of the vibratory portion.

In accordance with other aspects of the present invention, there is a bone conduction device comprising a vibrational element and a housing containing the vibrational element, the housing including an integral vibration isolator. The integral vibration isolator isolates a substantial portion of the housing from another portion of the housing exposed to vibrations generated by the vibrational element.

Figure 1:
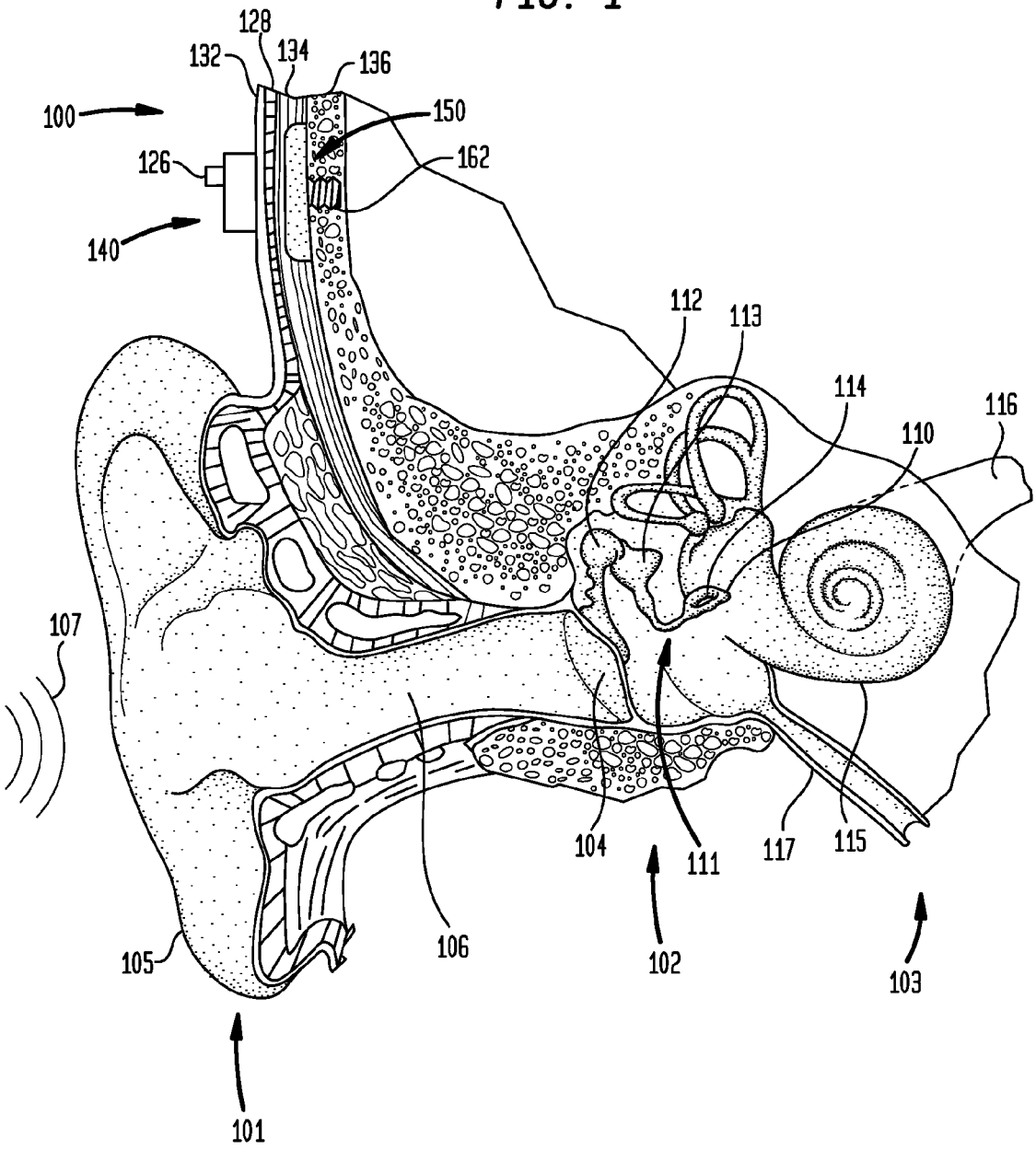
FIG. 1 is a perspective view of an exemplary bone conduction device in which embodiments of the present invention may be implemented.

FIG. 1 is a perspective view of a transcutaneous bone conduction device 100 in which embodiments of the present invention may be implemented. As shown, the recipient has an outer ear 101, a middle ear 102 and an inner ear 103. Elements of outer ear 101, middle ear 102 and inner ear 103 are described below, followed by a description of bone conduction device 100.

In a fully functional human hearing anatomy, outer ear 101 comprises an auricle 105 and an ear canal 106. A sound wave or acoustic pressure 107 is collected by auricle 105 and channeled into and through ear canal 106. Disposed across the distal end of ear canal 106 is a tympanic membrane 104 which vibrates in response to acoustic wave 107. This vibration is coupled to oval window or fenestra ovalis 110 through three bones of middle ear 102, collectively referred to as the ossicles 111 and comprising the malleus 112, the incus 113 and the stapes 114. The ossicles 111 of middle ear 102 serve to filter and amplify acoustic wave 107, causing oval window 110 to vibrate. Such vibration sets up waves of fluid motion within cochlea 139. Such fluid motion, in turn, activates hair cells (not shown) that line the inside of cochlea 139. Activation of the hair cells causes appropriate nerve impulses to be transferred through the spiral ganglion cells and auditory nerve 116 to the brain (not shown), where they are perceived as sound.

FIG. 1 also illustrates the positioning of bone conduction device 100 relative to outer ear 101, middle ear 102 and inner ear 103 of a recipient of device 100. As shown, bone conduction device 100 is positioned behind outer ear 101 of the recipient. Bone conduction device 100 comprises an external component 140 and implantable component 150. The bone conduction device 100 includes a sound input element 126 to receive sound signals. Sound input element 126 may comprise, for example, a microphone, telecoil, etc. In an exemplary embodiment, sound input element 126 may be located, for example, on or in bone conduction device 100, on a cable or tube extending from bone conduction device 100, etc. Alternatively, sound input element 126 may be subcutaneously implanted in the recipient, or positioned in the recipient's ear. Sound input element 126 may also be a component that receives an electronic signal indicative of sound, such as, for example, from an external audio device. For example, sound input element 126 may receive a sound signal in the form of an electrical signal from an MP3 player electronically connected to sound input element 126.

Bone conduction device 100 comprises a sound processor (not shown), an actuator (also not shown) and/or various other operational components. As will be detailed below, other types of bone conduction devices include an actuator that is implanted in the recipient. In operation, sound input device 126 converts received sounds into electrical signals. These electrical signals are utilized by the sound processor to generate control signals that cause the actuator to vibrate. In other words, the actuator converts the electrical signals into mechanical vibrations for delivery to the recipient's skull.

In accordance with embodiments of the present invention, a fixation system 162 is used to secure implantable component 150 to skull 136. As described below, fixation system 162 may be a bone screw fixed to skull 136, and also attached to implantable component 150. It is noted that in some embodiments, configurations utilizing more than one bone screw may be utilized.

In one arrangement of FIG. 1, bone conduction device 100 is a passive transcutaneous bone conduction device. That is, no active components, such as the actuator, are implanted beneath the recipient's skin 132. In such an arrangement, the active actuator is located in external component 140, and implantable component 150 includes a magnetic plate, as will be discussed in greater detail below. The magnetic plate of the implantable component 150 vibrates in response to vibration transmitted through the skin, mechanically and/or via a magnetic field, that are generated by an external magnetic plate.

In another arrangement, bone conduction device 100 is an active transcutaneous bone conduction device where at least one active component, such as the actuator, is implanted beneath the recipient's skin 132 and is thus operationally integrated with implantable component 150. As described below, in such an arrangement, external component 140 may comprise a sound processor and transmitter, while implantable component 150 may comprise a signal receiver and/or various other electronic circuits/devices.

Figure 2A:
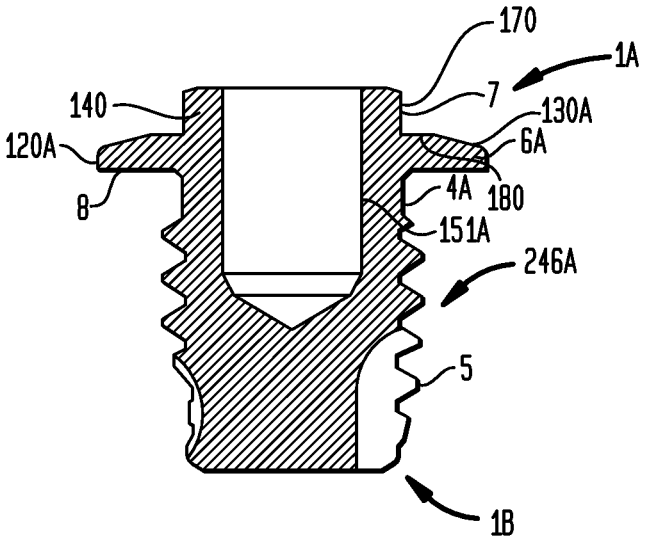
FIGS. 2A and 2B are schematic diagrams of exemplary bone fixtures with which embodiments of the present invention may be implemented.
Figure 2B:
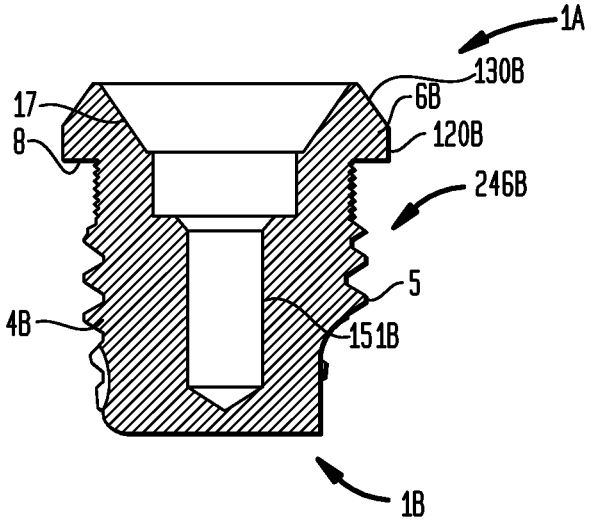

As previously noted, aspects of the present invention are generally directed to a bone conduction device including an implantable component comprising a bone fixture screw adapted to be screwed into a bone fixture osseointegrated in the recipient's skull, and a vibrational element attached to the bone fixture via the bone fixture screw. FIGS. 2A and 2B are cross-sectional views of bone fixtures 246A and 246B that may be used in exemplary embodiments of the present invention. Bone fixtures 246A and 246B are configured to receive an abutment, as will be detailed below.

Bone fixtures 246A and 246B may be made of any material that integrates into surrounding bone tissue (i.e., it is made of a material that exhibits acceptable osseointegration characteristics). In one embodiment, the bone fixtures 246A and 246B are made of titanium.

As shown, fixtures 246A and 246B each include main bodies 4A and 4B, respectively, and an outer screw thread 5 configured to be installed into the skull. The fixtures 246A and 246B also each respectively comprise flanges 6A and 6B configured to prevent the fixtures from being inserted too far into the skull.

Main bodies 4A and 4B have a length that is sufficient to securely anchor the bone fixtures into the skull without penetrating entirely through the skull. The length of main bodies 4A and 4B may depend, for example, on the thickness of the skull at the implantation site. In one embodiment, the main bodies of the fixtures have a length that is no greater than 5 mm, measured from the planar bottom surface 8 of the flanges 6A and 6B to the end of the distal region 1B. In another embodiment, the length of the main bodies is from about 3.0 mm to about 5.0 mm.

In the embodiment depicted in FIG. 2A, main body 4A of bone fixture 246A has a cylindrical proximate end 1A, a straight, generally cylindrical body, and a screw thread 5. The distal region 1B of bone fixture 246A may be fitted with self-tapping cutting edges formed into the exterior surface of the fixture.

Additionally, as shown in FIG. 2A, the main body of the bone fixture 246A has a tapered apical proximate end 1A, a straight, generally cylindrical body, and a screw thread 5. The distal region 1B of bone fixtures 246A and 246B may also be fitted with self-tapping cutting edges (e.g., three edges) formed into the exterior surface of the fixture.

A clearance or relief surface may be provided adjacent to the self-tapping cutting edges. Such a design may reduce the squeezing effect between the fixture 246A and the bone during installation of the screw by creating more volume for the cut-off bone chips.

As illustrated in FIGS. 2A-2B, flanges 6A and 6B have a planar bottom surface for resting against the outer bone surface, when the bone fixtures have been screwed down into the skull. In an exemplary embodiment, the flanges 6A and 6B have a diameter which exceeds the peak diameter of the screw threads 5 (the screw threads 5 of the bone fixtures 246A and 246B may have an outer diameter of about 3.5-5.0 mm). In one embodiment, the diameter of the flanges 6A and 6B exceeds the peak diameter of the screw threads 5 by approximately 10-20%. Although flanges 6A and 6B are illustrated in FIGS. 2A-2B as being circumferential, the flanges may be configured in a variety of shapes. Also, the size of flanges 6A and 6B may vary depending on the particular application for which the bone conduction implant is intended.

In FIG. 2B, the outer peripheral surface of flange 6B has a cylindrical part 120B and a flared top portion 130B. The upper end of flange 6B is designed with an open cavity having a tapered inner side wall 17. The tapered inner side wall 17 is adjacent to the grip section (not shown).

It is noted that the interiors of the fixtures 246A and 246B further respectively include an inner bottom bore 151A and 151B having internal screw threads for securing a coupling shaft of an abutment screw to secure respective abutments to the respective bone fixtures as will be described in greater detail below.

In FIG. 2A, the upper end 1A of fixture 246A is designed with a cylindrical boss 140 having a coaxial outer side wall 170 extending at a right angle from a planar surface 180A at the top of flange 6A.

In the embodiments illustrated in FIGS. 2A and 2B, the flanges 6A and 6B have a smooth, open upper end and do not have a protruding hex. The smooth upper end of the flanges and the absence of any sharp corners provides for improved soft tissue adaptation. Flanges 6A and 6B also comprise a cylindrical part 120A and 120B, respectively, that together with the flared upper parts 130A and 130B, respectively, provides sufficient height in the longitudinal direction for internal connection with the respective abutments that may be attached to the bone fixtures.

Figure 3:
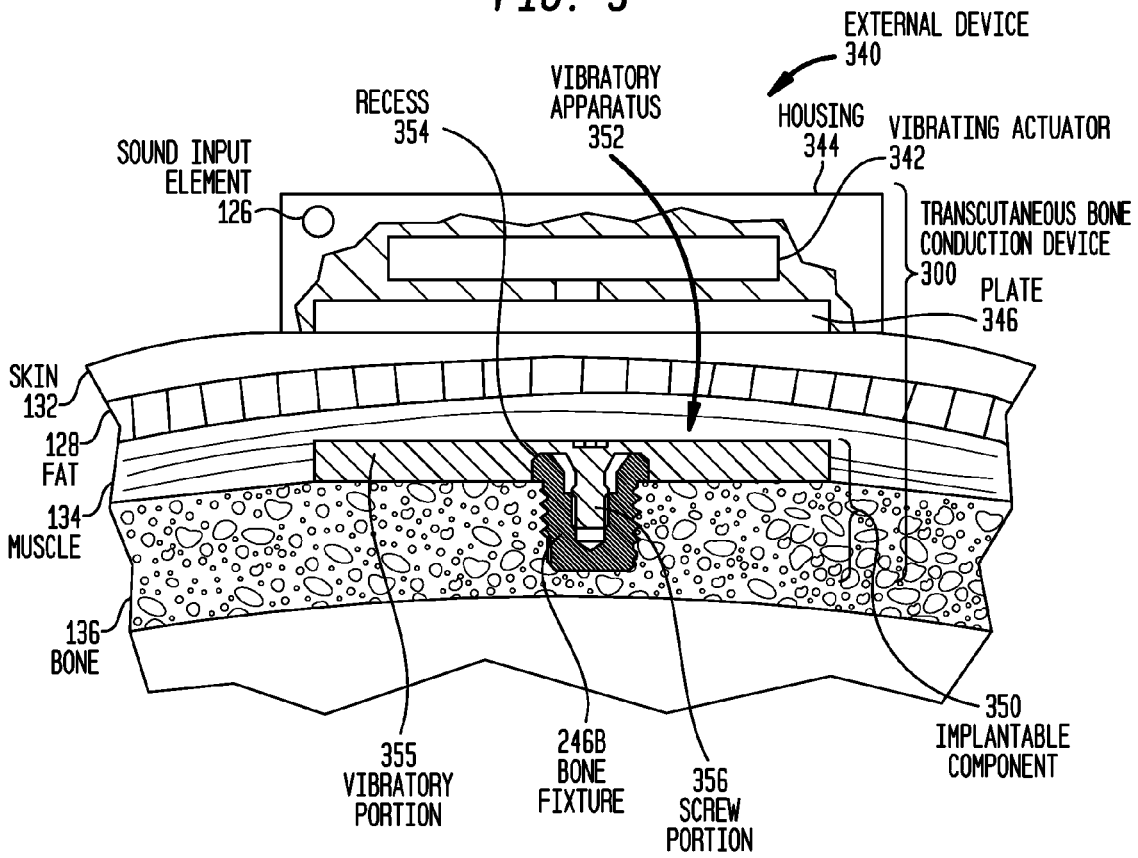
FIG. 3 is a schematic diagram illustrating an exemplary passive transcutaneous bone conduction device in which embodiments of the present invention may be implemented.

FIG. 3 depicts an exemplary embodiment of a transcutaneous bone conduction device 300 according to an embodiment of the present invention that includes an external device 340 and an implantable component 350. The transcutaneous bone conduction device 300 of FIG. 3 is a passive transcutaneous bone conduction device in that a vibrating actuator 342 is located in the external device 340. Vibrating actuator 342 is located in housing 344 of the external component, and is coupled to plate 346. Plate 346 may be in the form of a permanent magnet and/or in another form that generates and/or is reactive to a magnetic field, or otherwise permits the establishment of magnetic attraction between the external device 340 and the implantable component 350 sufficient to hold the external device 340 against the skin of the recipient.

In an exemplary embodiment, the vibrating actuator 342 is a device that converts electrical signals into vibration. In operation, sound input element 126 converts sound into electrical signals. Specifically, the transcutaneous bone conduction device 300 provides these electrical signals to vibrating actuator 342, or to a sound processor (not shown) that processes the electrical signals, and then provides those processed signals to vibrating actuator 342. The vibrating actuator 342 converts the electrical signals (processed or unprocessed) into vibrations. Because vibrating actuator 342 is mechanically coupled to plate 346, the vibrations are transferred from the vibrating actuator 342 to the implantable component 350.

The implantable component 350 comprises a vibratory apparatus 352 and a bone fixture 246B. Vibratory apparatus 352 includes a vibratory portion 355 (sometimes referred to herein as a vibrational element) and a screw portion 356. The vibratory portion 355 of the vibratory apparatus 352 of the implantable component 350 is made of a ferromagnetic material that may be in the form of a permanent magnet, that generates and/or is reactive to a magnetic field, or otherwise permits the establishment of a magnetic attraction between the external device 340 and the implantable component 350 sufficient to hold the external device 340 against the skin of the recipient. Accordingly, vibrations produced by the vibrating actuator 342 of the external device 340 are transferred from plate 346 across the skin to vibratory portion 355 of implantable component 350. This may be accomplished as a result of mechanical conduction of the vibrations through the skin, resulting from the external device 340 being in direct contact with the skin and/or from the magnetic field between the two plates. These vibrations are transferred without penetrating the skin with a solid object such as an abutment referred to herein with respect to a percutaneous bone conduction device.

As may be seen, the vibratory apparatus 352 is attached to bone fixture 246B in this embodiment. As indicated above, bone fixture 246A or other bone fixture may be used instead of bone fixture 246B in this and other embodiments. In this regard, vibratory apparatus 352 includes a recess 354 that is contoured to the outer contours of the bone fixture 246B. This recess 354 thus forms a bone fixture interface section that is contoured to the exposed section of the bone fixture 246B. It is noted that in other embodiments, the vibratory apparatus 352 may be configured such that the recess 354 is larger than that just described such that the vibratory portion 355 does not contact the bone fixture 246B, and only the screw portion contacts the bone fixture 246B. In an exemplary embodiment, the recess 354 is sized and dimensioned such that at least a slip fit or an interference fit exists with respect to the recess 354 and the bone fixture 246B. Screw portion 356 is used to secure the vibratory apparatus 352 to bone fixture 246B. As can be seen in FIG. 3, the vibratory apparatus 352 is a monolithic component comprising the screw portion 356 and the vibratory portion 355. The portions of screw portion 356 that interface with the bone fixture 246B substantially correspond to an abutment screw detailed in greater detail below, thus permitting screw 356 to readily fit into an existing bone fixture used in a percutaneous bone conduction device. In an exemplary embodiment, the implantable component 350 is configured so that the same tools and procedures that are used to install and/or remove an abutment screw from bone fixture 246B can be used to install and/or remove the vibratory apparatus 352 to/from the bone fixture 246B, as will be described in greater detail below.

Figure 4:
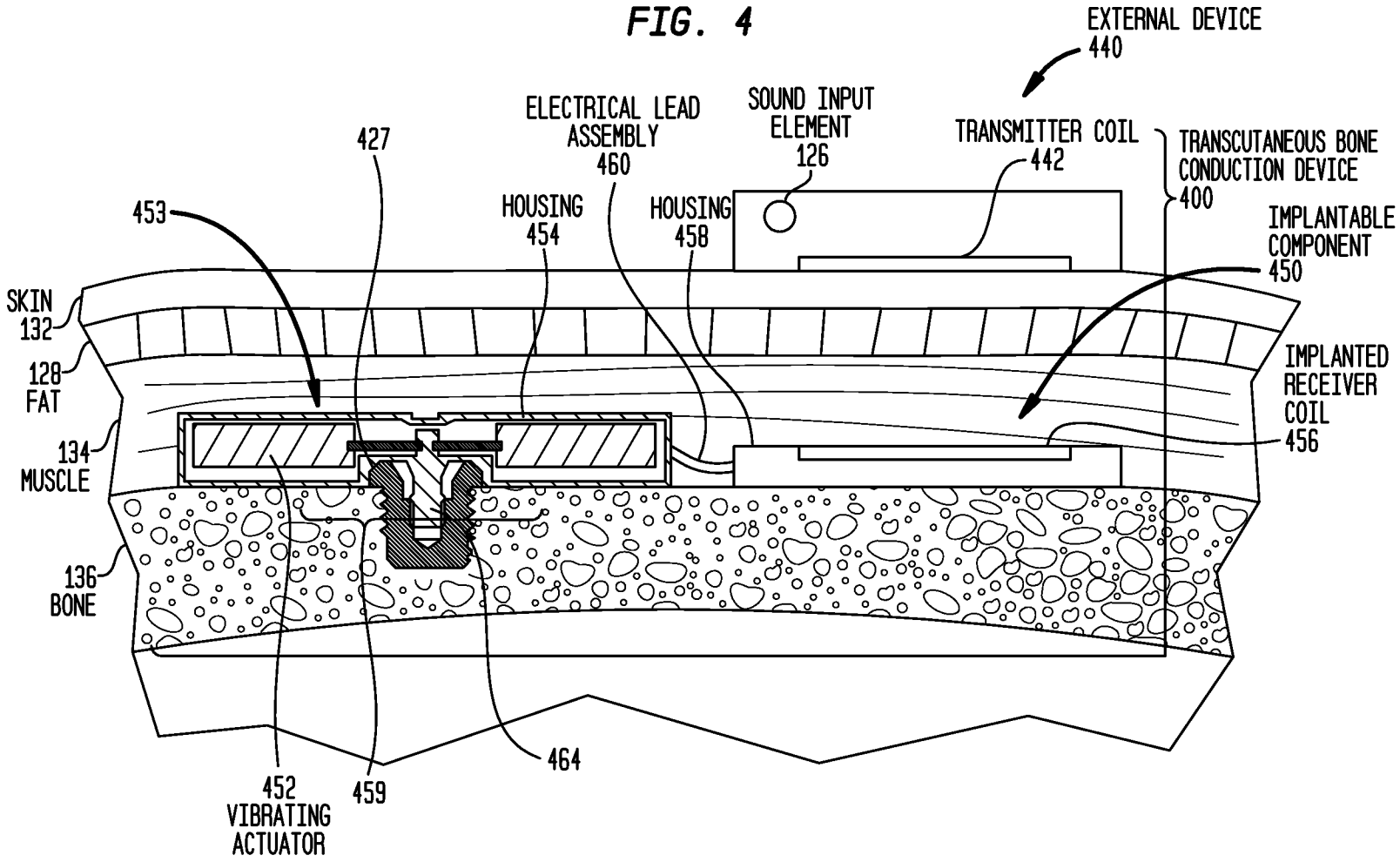
FIG. 4 is a schematic diagram illustrating an exemplary active transcutaneous bone conduction device in which embodiments of the present invention may be implemented.

FIG. 4 depicts an exemplary embodiment of a transcutaneous bone conduction device 400 according to another embodiment of the present invention that includes an external device 440 and an implantable component 450. The transcutaneous bone conduction device 400 of FIG. 4 is an active transcutaneous bone conduction device in that a vibrating actuator 452 (sometimes referred to herein as a vibrator and/or a vibrational element) is located in the implantable component 450. Specifically, a vibrational element in the form of vibrating actuator 452 is located in housing 454 of the implantable component 450. In an exemplary embodiment, much like the vibrating actuator 342 described above with respect to transcutaneous bone conduction device 300, the vibrating actuator 452 is a device that converts electrical signals into vibration.

External component 440 includes a sound input element 126 that converts sound into electrical signals. Specifically, the transcutaneous bone conduction device 400 provides these electrical signals to vibrating actuator 452, or to a sound processor (not shown) that processes the electrical signals, and then provides those processed signals to the implantable component 450 through the skin of the recipient via a magnetic inductance link. In this regard, a transmitter coil 442 of the external component 440 transmits these signals to implanted receiver coil 456 located in housing 458 of the implantable component 450. Components (not shown) in the housing 458, such as, for example, a signal generator or an implanted sound processor, then generate electrical signals to be delivered to vibrating actuator 452 via electrical lead assembly 460. The vibrating actuator 452 converts the electrical signals into vibrations.

The vibrating actuator 452 is located within the housing 454 of vibrating apparatus 453. The vibrating apparatus 453 includes a screw portion 464. Housing 454 and vibrating actuator 452 collectively form a vibrating portion. The housing 454 is attached to bone fixture 246B. In this regard, housing 454, and thus the vibratory portion of the implantable component 450, is rigidly adhered to a screw 464 that is used to secure housing 454, and thus the vibratory apparatus 453, to bone fixture 246B. The portions of screw 464 that interface with the bone fixture 246B substantially correspond to the abutment screw detailed above, thus permitting screw 464 to readily fit into an existing bone fixture used in a percutaneous bone conduction device (or an existing passive bone conduction device such as that detailed above).

As may be seen, housing 454 includes a recess 427 that is contoured to the outer contours of the bone fixture 246B. This recess 427 thus forms a bone fixture interface section that is contoured to the exposed section of the bone fixture 246B, although in other embodiments, this recess 427 is configured to avoid contact with the bone fixture 246B. It is noted that in other embodiments, the vibratory apparatus 453 may be configured such that the housing 452 does not contact the bone fixture 246B.

In an exemplary embodiment, at least a substantial portion (including all) of the housing 454 (e.g., the bottom portion of the housing 454 falling within bracket 459) and the screw portion 464 form a monolithic component. In an exemplary embodiment, the housing 454 in combination with the screw portion 464 is configured so that the same tools and procedures that are used to install and/or remove an abutment screw to/from bone fixture 246B can be used to install and/or remove the housing 454 with screw portion 464 to/from the bone fixture 246B, as will be described in greater detail below.

More detailed features of the embodiments of FIG. 3 and FIG. 4 will now be described.

Figure 5:
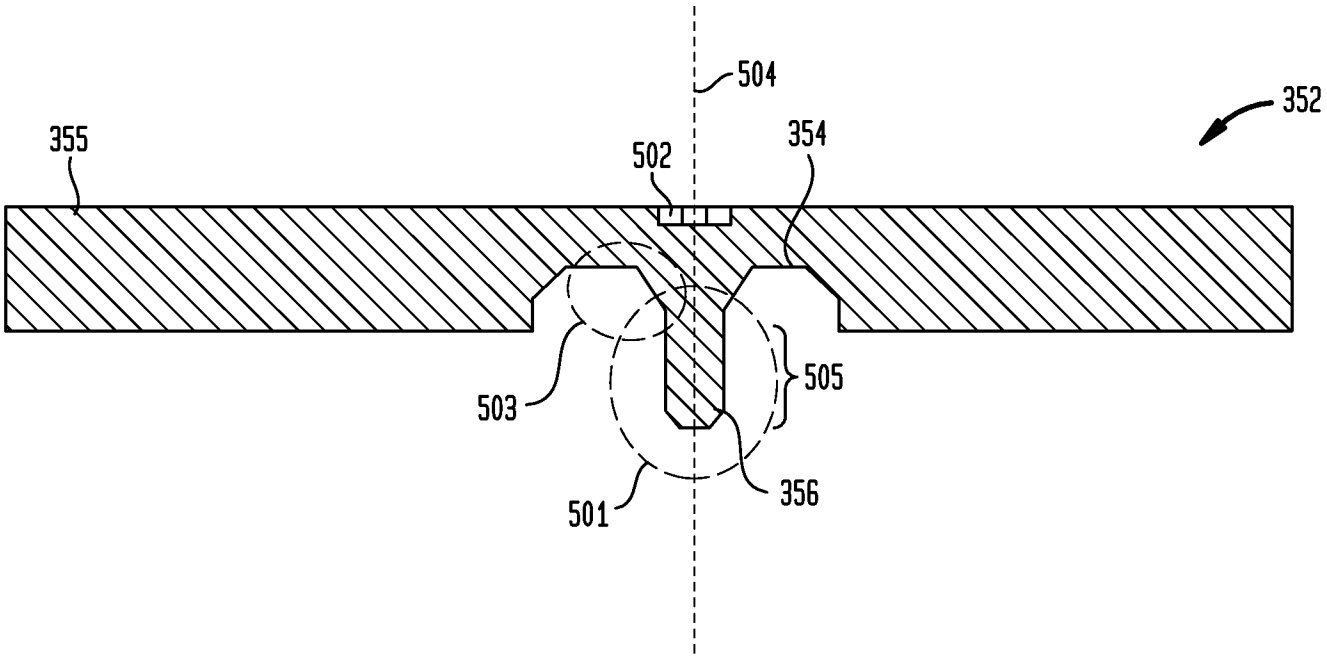
FIG. 5 is a schematic diagram illustrating an exemplary portion of the implantable component of a passive transcutaneous bone conduction device according to an embodiment of the present invention.

FIG. 5 depicts an enlarged view of a cross-section of the vibratory apparatus 352 of implantable component 350 of FIG. 3 according to an exemplary embodiment in cross-sectional form on a plane lying on longitudinal axis 504. In the embodiment depicted in FIG. 5, vibratory portion 355 is in the form of a flat plate having a substantially flat bottom side and upper side and having a circular outer circumference in the form of a cylindrical outer wall. It is noted that in other embodiments, the vibratory portion 355 may have other configurations, such as a conical outer wall and a curved upper side, etc. Further exemplary configurations are described below. In an exemplary embodiment, the vibratory portion 355 is a generally flat circular plate from which a screw portion 356 extends. In the embodiment depicted in FIG. 5, the structure located within dashed lines 501 corresponds to the screw portion 356 including female screw threads located with brackets 505 (although the extent of such threads may be greater than that or less than that), and at least some (including all) of the portion outside of dashed lines 501 corresponds to the vibratory portion. It will be understood that the size and shape of dashed lines 501 may vary with respect to other embodiments.

In the embodiment of the vibratory apparatus 352 depicted in FIG. 5, the screw portion 356 and the vibratory portion 355 are machined and/or casted or otherwise made from a single piece of ferromagnetic material. In the embodiment of FIG. 5, the vibratory apparatus 352 is a monolithic component. Accordingly, the vibratory portion 356 is rigidly adhered to the screw portion 356 and rotation imparted on the vibratory portion 355 imparts a corresponding rotation to the screw portion 356. In an exemplary embodiment, the vibratory apparatus 352 is configured to transfer a torque an installation torque and/or break torque, such as torques of about 30 Ncm, about 40 Ncm, about 60 Ncm, about 80 Ncm, about 100 Ncm, about 120 Ncm, about 140 Ncm, about 160 Ncm, and/or about 180 Ncm applied to the vibratory portion 355 (e.g., via an Allen wrench at Allen wrench receptacle 502 and/or via a spanner wrench interfacing with vibratory portion 355 at the periphery thereof as detailed below) acting about longitudinal axis 502 to the screw portion 356 without the screw portion 356 effectively rotating relative to the vibratory portion 355 (i.e., more rotation than about that due to material deformation), and/or visa-versa. In an exemplary embodiment, the device may be tested utilizing a clamp or the like applied to screw portion 356 configured to prevent screw portion 356 from rotating when any of the just-mentioned torques are applied to the vibratory portion 355. If the screw is clamped to prevent rotation, this would also prevent the vibratory portion from effectively rotating relative to the clamp (and thus the screw portion 356).

As noted above, the embodiment of FIG. 5 is a monolithic structure. However, in other embodiments, the vibratory portion 355 is a separate component from the screw portion 356 that is rigidly adhered thereto. By way of example, the screw portion may be welded or otherwise joined to the vibratory portion. In such an embodiment, the resulting weld may result in an exterior surface area of the vibratory apparatus 352 that encompasses at least a portion of a surface of the vibratory portion 355 and at least a portion of a surface of the screw portion 356 that is gapless and/or seamless. Such a surface area may correspond to the surface area depicted within dashed lines 503 extrapolated all the way about longitudinal axis 504. A seamless surface may be obtained by, for example, grinding or polishing the weld joint between the two components to be seamless. In this regard, FIG. 5 depicts an embodiment where a sub-portion of the vibratory portion 355 and a sub-portion of the screw portion 356 seamlessly interface with one another.

With respect to the just-described embodiment, it is noted that the surfaces of the vibratory portion and the screw portion may include sub-surface portions that extend orthogonal to one another, as may be seen in FIG. 5. Thus, all surfaces within dashed lines 503 are without a gap and/or a seam. This is in contrast to a vibratory apparatus which is made from a screw extending through a plate where the screw is configured to rotate substantially freely with respect to the plate, where there will be a gap and/or seam at the interface between the two components in which micro-organisms may collect.

In yet another embodiment, part or all of the monolithic construction may be coated with another material. The monolithic construction may be of a ferromagnetic material and the coating covering at least area 501 could be of an osseointegrating material such as titanium.

Figure 5A:
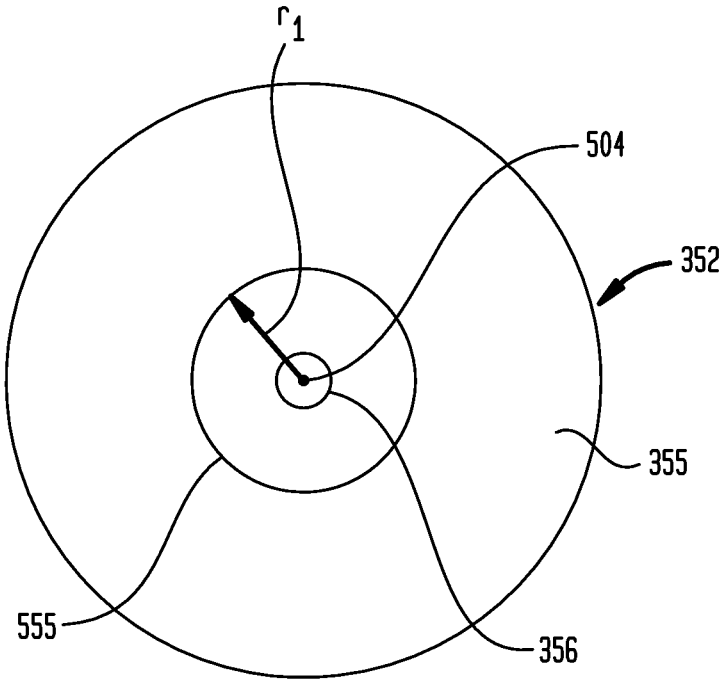
FIG. 5A is a schematic diagram illustrating a bottom perspective view of the embodiment of FIG. 5.

It is noted that in the exemplary embodiments detailed herein and variations thereof that recite the absence of a gap and/or seam in a given area, that area may be an area encompassing surfaces extending from the boundary of the male screw threads of screw portion 356 (i.e., the end of the male screw threads closest to the vibratory portion 355) to a location at the vibratory portion 355, such as, for example, a location on the boundary of a circle transposed onto the bottom of the vibratory portion 355 centered about the longitudinal axis 504 having a radius of about ¼ inches, about ½ inches, about ¾ inches, about 1 inch, about 1.25 inches, about 1.5 inches, about 1.75 inches, about 2 inches or more. FIG. 5A depicts a bottom view of vibratory apparatus 352 (i.e., looking upward in the plane of FIG. 5/looking at the side of the vibratory apparatus on which the screw portion 356 is located) onto which such an exemplary location corresponding to circle 555 having a radius r1 of about ½ inches centered about longitudinal axis 504 has been transposed. In an exemplary embodiment, such an area may be the area encompassing surfaces extending from the boundary of the male screw threads of screw portion 356 to the outer circumference of the bottom of vibratory portion 355 (e.g., the radius r1 would equal the radius of the outer profile of the vibratory apparatus 352).

It is further noted that in some embodiments, the vibratory portion 355, which is rigidly adhered to screw portion 356, may not be a monolithic body. In an exemplary embodiment, a first portion of the vibratory portion 355 is monolithic with all or at least a portion of the screw portion 356, and another portion of the vibratory portion 355 is joined or otherwise linked to the first portion of the vibratory portion 355. In such an embodiment, at least a sub-portion of the vibratory portion and at least a sub-portion of the screw portion may seamlessly and/or gaplessly interface with one another owing to the monolithic nature of the first portion and the screw portion.

Embodiments corresponding to those detailed herein and variations thereof that are seamless and/or gapless may be achieved via any method or system providing that such seamlessness and gaplessness is achieved.

It is noted that with respect to the cross-sectional views presented herein, the cross-sectional views depict views corresponding to any cross-section lying on a plane on the longitudinal axis of the device depicted unless otherwise noted and/or otherwise understood by the person of skill in the art (e.g., the Allen wrench receptacle 502 being such an example).

In an exemplary embodiment, the entire outer surface of the vibratory apparatus 352 may be substantially smooth, seamless and/or gapless, with the possible exception of the threads of the screw portion 356 and the locations for wrench attachment (e.g., receptacle 502). In an exemplary embodiment, the wrench attachment locations may be contoured such that they are substantially smooth, seamless and/or gapless. In such embodiments, because the screw portion is located within bone and/or within a bone fixture, in some embodiments, the entire exposed surface of the vibratory apparatus 352 is substantially smooth, seamless and/or gapless. This limits the ability of bacteria to congregate on the vibratory apparatus 352 and/or limits the ability of a biofilm to develop. In an exemplary embodiment, biofilm development may be further enhanced by removing the receptacle 502 altogether and using a tool that interfaces with the outer edge of the monolithic structure, as will be described below. This could be facilitated by making the shape of the implantable component a shape other than circular, such as square or hexagonal.

Figure 6:
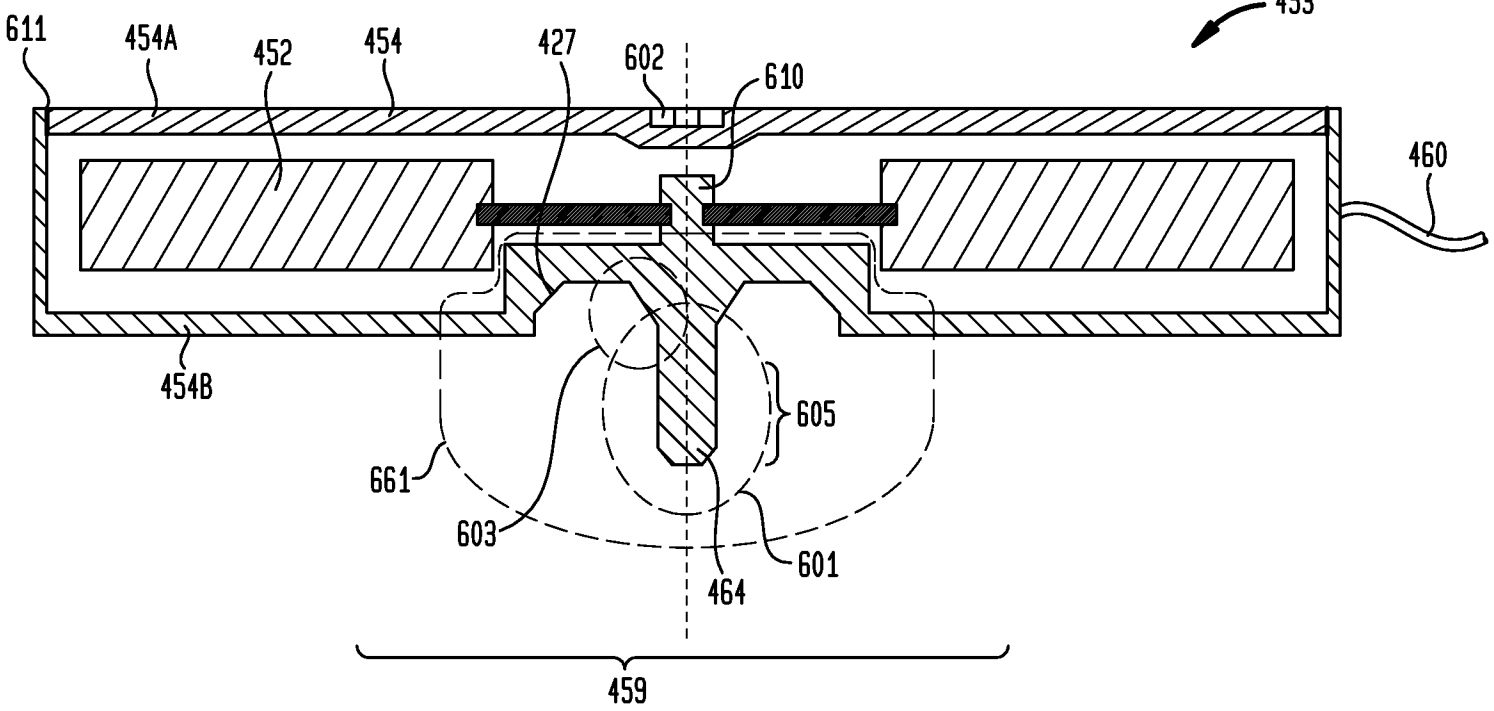
FIG. 6 is a schematic diagram illustrating another exemplary portion of the implantable component of a passive transcutaneous bone conduction device according to an embodiment of the present invention.

FIG. 6 depicts an enlarged view of the vibratory apparatus 453 of implantable component 450 of FIG. 4 according to an exemplary embodiment in cross-sectional form on a plane lying on longitudinal axis 604. In the embodiment depicted in FIG. 6, housing 454 of the vibratory portion is in the form of a hermetically sealed housing that has an outer configuration in the form of a circular plate from which a screw portion 464 extends. The housing has a substantially flat bottom side and upper side and has a circular outer circumference in the form of a cylindrical outer wall. It is noted that in other embodiments, the housing 454 may have other configurations, such as a conical outer wall and a curved upper side, etc. Further exemplary configurations are described below. In an exemplary embodiment, the housing 454 contains vibrating actuator 452 which is vibrationally linked to housing 454 via structural component 610, as will be further discussed below. In the embodiment depicted in FIG. 6, vibratory portion corresponds to (i) the structure located within dashed lines 601 corresponds to the screw portion 464 and includes female screw threads located with brackets 605 (although the extent of such threads may be greater than that or less than that), and (ii) at least some (including all) of the portion of the housing 454 and/or the vibrating apparatus 453 outside of dashed lines 601 plus the vibrating actuator 452. It will be understood that the size and shape of dashed lines 601 may vary with respect to other embodiments.

In the embodiment of the vibratory apparatus 453 depicted in FIG. 6, the screw portion 464 and at least a portion of the housing 454 (e.g., those portions of the housing falling within dashed lines 611) are machined and/or casted or otherwise made from a single piece of material. In the embodiment of FIG. 6, the portions of the housing 454 and screw portion 464 within dashed lines 611 are a monolithic component. Accordingly, the portions of the housing 454 within the dashed lines 611 are rigidly adhered to the screw portion 464 and rotation imparted on the portions of the housing 454 within dashed lines 611 imparts a corresponding rotation to the screw portion 464. In an exemplary embodiment, housing 454 is formed by top part 454A that is formed separate from bottom part 454B. These two parts are joined at interface section 661 (e.g., via welding, via interference fit, via a screw arrangement, etc.) after vibrating actuator 452 is located within the housing 454, thereby hermetically sealing vibrating actuator therein. The portion of the bottom part 454B (i.e., the portion of housing 454 extending to interface section 661) and screw portion 464 form a monolithic component, as may be seen owing to the continuous nature of the cross-hatching of bottom part 454B and screw portion 464. In an exemplary embodiment, the bottom part 454B and/or the portion of the housing 454 within dashed lines 611 is configured to transfer a torque of about 30 Ncm, about 40 Ncm, about 60 Ncm, about 80 Ncm, about 100 Ncm, about 120 Ncm, about 140 Ncm, about 160 Ncm, and/or about 180 Ncm applied thereto (e.g., as a result of torque applied to top part 454A via an Allen wrench at Allen wrench receptacle 602, wherein the interface section 661 is sufficiently robust to transfer the torque from top part 454A to bottom part 454B) acting about longitudinal axis 602 to the screw portion 464 without the screw portion 454 effectively rotating relative to the bottom part 454B and/or the portion within dashed lines 611 (i.e., more rotation than about that due to material deformation), and/or visa-versa. In an exemplary embodiment, a clamp or the like applied to screw portion 464 configured to prevent screw portion 464 from rotating when any of the just-mentioned torques are applied to the bottom part 454B and/or to the portion within dashed lines 611 would prevent the vibratory portion from effectively rotating relative to the clamp (and thus the screw portion 464).

From FIG. 6, it can be seen that electrical leads 460 extend to housing 454. In an exemplary embodiment, one or more feedthroughs are located in housing wall 454 to permit electrical leads 460 to be connected and/or disconnected to vibratory apparatus 453. This may have utility in that because the entire housing 454 is rotated during implantation of the vibratory apparatus 453 to the recipient, the electrical leads 460 may be connected after rotation of the housing 454 is completed, thus preventing leads from being tangled or twisted and/or reducing the length of the lead. In some embodiments, multiple feedthroughs may be added to the housing 454 (e.g., one every 90 degrees about the outer periphery of the housing 454) to provide flexibility in positioning the housing 454. In an exemplary embodiment, this may permit a surgeon or the like to choose the feedthrough closest to the lead 460, as opposed to having to rotationally align the housing 454 with the lead 460.

As noted above, the embodiment of FIG. 6 depicts a monolithic structure within the dashed line 611. However, in other embodiments, the portion of the housing 454 is a separate component from the screw portion 464 that is rigidly adhered thereto. By way of example, the screw portion may be welded or otherwise joined to the bottom part 454B of housing 454. In such an embodiment, the resulting weld may result in an exterior surface area of the vibratory apparatus 453 that encompasses at least a portion of a surface of the vibratory portion (e.g., bottom part 454B of housing 454 and at least a portion of a surface of the screw portion 464 that is gapless and/or seamless. Such a surface area may correspond to the surface area depicted within dashed lines 603 extrapolated all the way about longitudinal axis 604. A seamless surface may be obtained by, for example, grinding or polishing the weld joint between the two components to be seamless. In this regard, FIG. 6 depicts an embodiment where a sub-portion of the vibratory portion (e.g., a sub-portion of bottom portion 454B) and a sub-portion of the screw portion 464 seamlessly interface with one another.

With respect to the just-described embodiment, it is noted that the surfaces of the vibratory portion and the screw portion may include sub-surface portions that extend orthogonal to one another, as may be seen in FIG. 6. Thus, all surfaces within dashed lines 603 are without a gap and/or a seam. This is in contrast to a vibratory apparatus which is made from a screw extending through a housing where the screw is configured to rotate substantially freely with respect to the housing, where there will be a gap and/or seam at the interface between the two components in which micro-organisms may collect.

It is noted that in the exemplary embodiments detailed herein and variations thereof that recite the absence of a gap and/or seam in a given area, that area may be an area encompassing surfaces extending from the boundary of the male screw threads of screw portion 464 (i.e., the end of the male screw threads closest to housing 454) to a location at the vibratory portion, such as, for example, a location on the boundary of a circle transposed onto the bottom surface of the housing 454 centered about the longitudinal axis 604 having a radius of about ¼ inches, about ½ inches, about ¾ inches, about 1 inch, about 1.25 inches, about 1.5 inches, about 1.75 inches, about 2 inches or more. In an exemplary embodiment, such an area may be the area encompassing surfaces extending from the boundary of the male screw threads of screw portion 464 to the outer circumference of the housing 454.

It is further noted that in some embodiments, the housing 454 and/or the bottom part 454B of housing 454 may not be a monolithic body. In this regard, there may be a seam or gap located on the bottom of the vibratory portion. In an exemplary embodiment, a first portion of the bottom part 454 is monolithic with all or at least a portion of the screw portion 356, and another portion of the vibratory portion 355 is joined or otherwise linked to the first portion of the vibratory portion 355. In such an embodiment, at least a sub-portion of the vibratory portion and at least a sub-portion of the screw portion may seamlessly and/or gaplessly interface with one another owing to the monolithic nature of the first portion and the screw portion.

Figure 7:
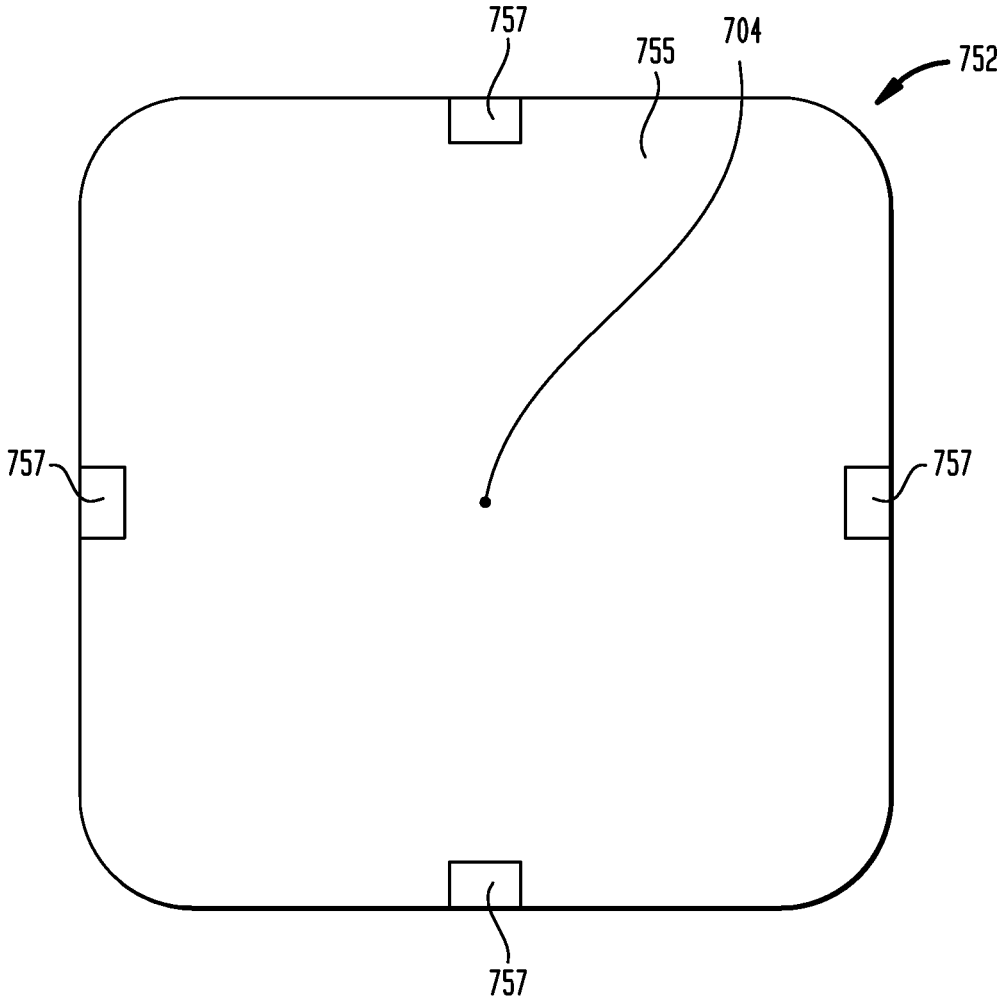
FIG. 7 is a schematic diagram illustrating another exemplary portion of the implantable component of a bone conduction device according to an embodiment of the present invention.

Embodiments described above have been described in terms of a vibratory apparatus to which a torque is applied via an Allen wrench interfacing with the vibratory apparatus at an Allen wrench socket located at the longitudinal axis of the vibratory apparatus (e.g., geometric center). In other embodiments, torque may be applied at the boundaries of the vibratory apparatus such as depicted in FIG. 7. Specifically, FIG. 7 depicts a top view of a vibratory apparatus 752 having a generally square outer profile including a vibratory portion 755. Four wrench sockets 757 are located at about the periphery of the vibratory portion 755. These wrench sockets are configured to receive a spanner wrench or the like and configured to receive the torque applied by the spanner wrench. It is noted that the sockets 757 may be utilized with other embodiments herein and variations thereof, such as those having a generally circular outer profile. It is also noted that the wrench sockets 757 may be located in housing 454 instead of or in addition to Allen wrench socket 602. Any configuration that will permit torque to be applied to the vibratory apparatuses in general and the vibratory portions in particular as detailed herein and variations thereof and transfer that torque to the screw portions detailed herein and variations thereof may be used in at least some embodiments.

In an exemplary embodiment, the entire outer surface of the vibratory apparatus 453 may be substantially smooth, seamless and/or gapless, with the possible exception of the threads of the screw portion 464 and the locations for wrench attachment (e.g., receptacle 602) and the location of the feedthroughs. In an exemplary embodiment, the wrench attachment locations may be contoured such that they are substantially smooth, seamless and/or gapless. In such embodiments, because the screw portion is located within bone and/or within a bone fixture, in some embodiments, the entire exposed surface of the vibratory apparatus 352 is substantially smooth, seamless and/or gapless. This limits the ability of bacteria to congregate on the vibratory apparatus 352 and/or limits the ability of a biofilm to develop.

Figure 8:
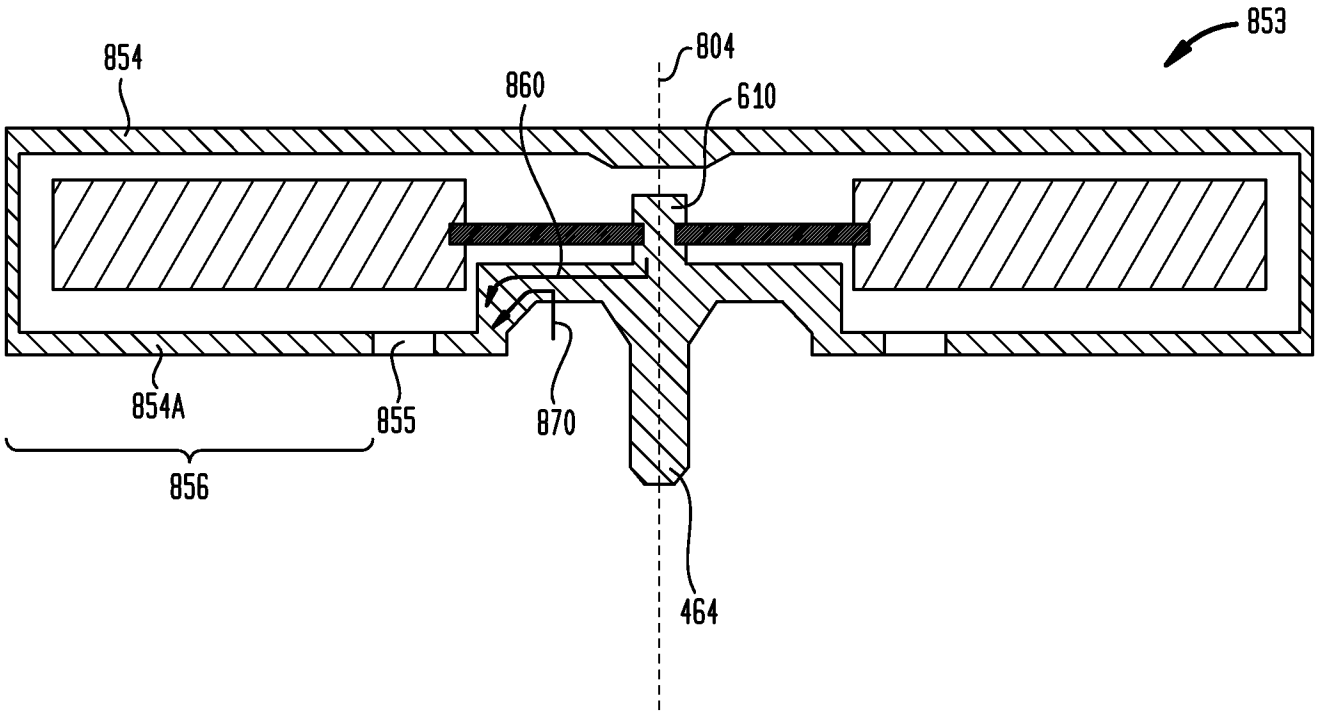
FIG. 8 is a schematic diagram illustrating another exemplary portion of the implantable component of an active transcutaneous bone conduction device according to an embodiment of the present invention.

FIG. 8 depicts another embodiment of a vibratory apparatus 853 of an active transcutaneous bone conduction device. In the exemplary embodiment of FIG. 8, which depicts a cross-sectional view of the vibratory apparatus 853, the vibratory apparatus 853 corresponds to vibratory apparatus 453 detailed above with respect to FIGS. 4 and 6, with the exception that the vibratory apparatus 853 includes a vibration isolator 855 that is integral with the housing 854 (which corresponds to housing 454 disclosed above with the exception of the added integral vibration isolator 855). The vibration isolator extends in a circular manner about longitudinal axis 804. However, in other embodiments, the vibration isolator 855 may extend in another manner (e.g., it may extend elliptically, or may extend along a path corresponding to a square, a rectangle, etc.).

In an exemplary embodiment, the housing 854 contains vibrating actuator 452 which is vibrationally linked to housing 854 via structural component 610, consistent with the embodiment of FIG. 6 detailed above. During use, vibrations generated by vibrating actuator 452 are transmitted to structural component 610, which supports vibrating actuator 452 in housing 854 such that vibrating actuator 854 does not contact any other part of the housing 854. From structural component 610, these vibrations are mechanically transmitted to screw portion 464. In this regard, with respect to the embodiment depicted in FIG. 8 (as with the embodiment depicted in FIG. 6) structural component 610 and screw portion 464 form a monolithic component, although other configurations may exist in other embodiments providing that vibrations from structural component 610 (or from vibrating actuator 452) are transmitted to screw portion 464. Vibrations are transmitted from screw portion 464 to bone fixture 246B, and from bone fixture 246B into bone 136.

It is noted that in some embodiments, vibrations may also be transmitted from structural component 610 to housing 854. Vibrations may also be transmitted from bone fixture 246B (after being transmitted to screw portion 464 thereto) into housing 854 if bone fixture 246B is in contact with housing 854 in a manner sufficient to transfer vibrations. In such exemplary embodiments, vibrations/vibratory energy may be transferred through the housing radially outward away from the center bottom of the housing 852, as indicated by vibrational paths 860 and 870 (path 870 being present if there is contact between bone fixture 246B and housing 852 sufficient to transfer vibrations from the bone fixture to the housing), respectively, as depicted in FIG. 8. The integral vibration isolator 855 notwithstanding, these vibrations may radiate outwardly along/in the bottom housing wall 854A of housing 854 (and along bottom part 454B of the housing 454) towards, if not to, the outer periphery thereof. In some embodiments, bottom housing wall 854A of housing 854 (and that of housing 454) may interface with, and in some instances osseointegrate to, or otherwise be in vibratory communication in the longitudinal direction with, bone 136, as is depicted by way of example in FIG. 4. In such an exemplary embodiment, these vibrations travelling along/in the bottom housing wall 854A of housing 854 (and housing 454) may be communicated in the longitudinal direction to bone 136 (i.e., directly downward from bottom housing wall), thus vibrating the surface of bone 136. As these vibrations may be out of phase with the vibrations delivered via the housing, the overall efficiency of the vibration delivery to the skull is reduced. In some embodiments utilizing integral vibration isolator 855, the vibrations that would otherwise travel along/in the bottom housing wall 854A are stopped or otherwise effectively damped by isolator 855. That is, in some embodiments, vibrations travelling along paths 860 and/or 870 do not travel outwardly from the center of housing 854 beyond isolator 855. Also, in some embodiments, vibrations travelling along paths 860 and/or 870 travel outwardly from the center of housing 854 beyond isolator 855 having substantially dampened/reduced energy from that which would otherwise be the case in the absence of the isolator 855.

Accordingly, in some embodiments having the integral vibration isolator 855, the vibratory apparatus 853, after implantation, is effectively vibrationally isolated (including totally vibrationally isolated) from the skull except for a path through the bone fixture 246B and/or a path through bone immediately proximate the bone fixture (e.g., the path extending downward from bottom housing wall inboard of isolator 855 that contacts or is otherwise in vibational communication in the longitudinal direction with bone 136). In this regard, in some embodiments, the vibration isolator 855 may be located further inboard such that vibrations travelling along/in the housing 854 do not reach the bottom of the hosing, and thus the path is effectively limited to a path through the bone fixture 246B.

As noted above, the vibration isolator 855 is integral to the housing. In an exemplary embodiment, as depicted in FIG. 8 (and FIGS. 9 and 10, as will be discussed below), the integral vibration isolator 855 is a sub-portion of the housing proximate the screw portion 464 and/or the bone fixture 246B when attached thereto. In an exemplary embodiment such as those depicted in FIGS. 8-10, the sub-portion of the housing making up the vibration isolator 855 is located, with respect to a radial direction of the bone conduction device, between the screw portion 464 (and/or the bone fixture 246B when attached thereto) and a second sub-portion of the housing (e.g., the portion of bottom housing wall 854A within bracket 856) not having significant vibration isolation characteristics.

In an exemplary embodiment, vibration isolator 855 is made of a different material than portions of the housing 854 inboard of vibration isolator 855. Vibration isolator 855 may be designed such that there is a significant acoustic impedance mismatch between housing 854 inboard of the vibration isolator and the vibration isolator 855 and ideally poor acoustic transmission through vibration isolator 855. This may be also the case with other vibration isolators detailed herein. This may be achieved by a significant change in the cross sectional thickness of the material and/or making the path less direct as in putting a crease in the material. In an exemplary embodiment, vibration isolator 855 may be made of material such as polytetrafluoroethylene while other portions of the housing, such as the portions of the housing inboard of vibration isolator 855, may be made of, for example, titanium, or, for example, stainless steel, etc. Any material that may be used to form a vibration isolator that is integral to housing 854 that will enable the vibratory apparatus 853 in general and housing 854 in particular to achieve the vibratory characteristics detailed herein and variations thereof may be used in some embodiments. In this regard, in some exemplary embodiments, any discontinuity of material making up bottom housing wall 854A may be used to achieve the vibratory characteristics detailed herein and variations thereof. Accordingly, in an exemplary embodiment, housing 854 may be made completely of titanium or a titanium alloy at all locations (including the portion within bracket 865) except at vibration isolator 855, which may be made of a material different from titanium or a titanium alloy that achieves the vibration isolation characteristics detailed herein and variations thereof.

In some embodiments, vibration isolator 855 extends in the radial direction about 2%, about 4%, about 6%, about 8%, about 10%, about 15%, about 20%, about 30%, about 40%, about 50%, about 60%, about 70%, about 80%, about 90% or about 100% or about any percentage between any of these percentages, in 1% increments or about 1% increments, of the total outer diameter of housing 854 as measured on a plane normal to the longitudinal axis 804. Accordingly, in some embodiments, vibration isolator 855 may comprise the entire bottom housing wall 854A of housing 854.

In an exemplary embodiment, vibration isolator 855 extends completely through the bottom wall 854A of housing 854, as shown in FIG. 8. In other exemplary embodiments, the vibration isolator 855 extends partially thorough the bottom wall 854A of housing 854.

In an exemplary embodiment, vibration isolator corresponds to a section of the housing, extending from the top of the bottom housing wall 854A to the bottom of the housing wall 854A, having a first percentage by volume of a first material or a first material mixture (i.e., an alloy or laminate), and optionally having a second percentage by volume of a second material or a second material mixture. In such an exemplary embodiment, the second percentage by volume may be material or material mixture of the housing outside of the vibration isolator 855, such as the material of the housing proximate the screw portion 464, although this second material or material mixture may not be present.

Figure 9:
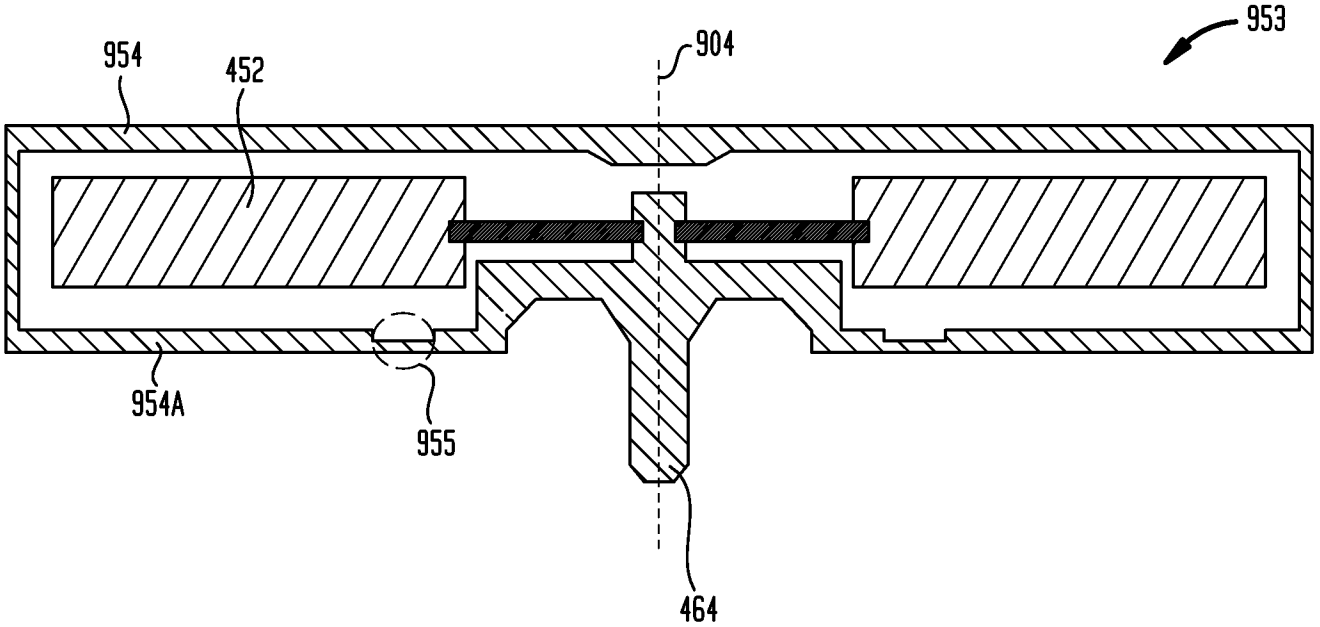
FIG. 9 is a schematic diagram illustrating another exemplary portion of the implantable component of an active transcutaneous bone conduction device according to an embodiment of the present invention.

FIG. 9 depicts an alternate embodiment of a vibratory apparatus 953 including a housing 954 having an integral vibration isolator located within dashed lines 955. In the embodiment of FIG. 9, the vibration isolator 955 is made of the same material as that of the housing 954 on either side of the vibration isolator 955 or the entire housing 954. The vibration isolator 955 corresponds to a portion of bottom housing wall 954A that is thinner, as measured in the direction parallel to longitudinal axis 904 (hereinafter, with respect to the embodiment of FIG. 9, this measurement is referred to as the "thickness"), than portions on one or both sides thereof or of the entire housing 954. In an exemplary embodiment, the thickness of vibration isolator 955 may be about 2%, about 4%, about 6%, about 8%, about 10%, about 15%, about 20%, about 25%, about 30%, about 35% about 40%, about 45%, about 50%, about 60%, about 70%, about 80% or about 90% of the thickness of the housing wall on one or both sides of the isolator 955, or about any percentage between any of these percentages, in 1% increments or about 1% increments, providing that such thickness may achieve the vibration isolation characteristics detailed herein and variations thereof.

It is noted that while the vibration isolator 955 of FIG. 9 is depicted as section having an abrupt change in thickness relative to a portion of the housing wall proximate thereto, other embodiments may include a vibration isolator 955 that has a thickness that gradually reduces from the thickness of the housing wall proximate thereto. By way of example, the top of vibration isolator 955 may gradually slope from the top of the housing wall proximate thereto. The slope may be a linear slope or a curved slope. The vibration isolator 955 may transition in a stepwise manner as well. Also, the transition back to the full wall thickness or a wall thickness different from that of the vibration isolator 955 may also be gradual, if such a transition exist (which may not be the case in embodiments where the vibration isolator 955 extends all the way to the periphery or about the periphery of housing 954.

While the embodiment of FIG. 9 is depicted as having a vibration isolator 955 that has a bottom that is flush with the bottom of bottom housing wall 954A, other embodiments may include a vibration isolator 955 that is recessed with respect to the bottom of bottom housing wall 954A.

Figure 10:
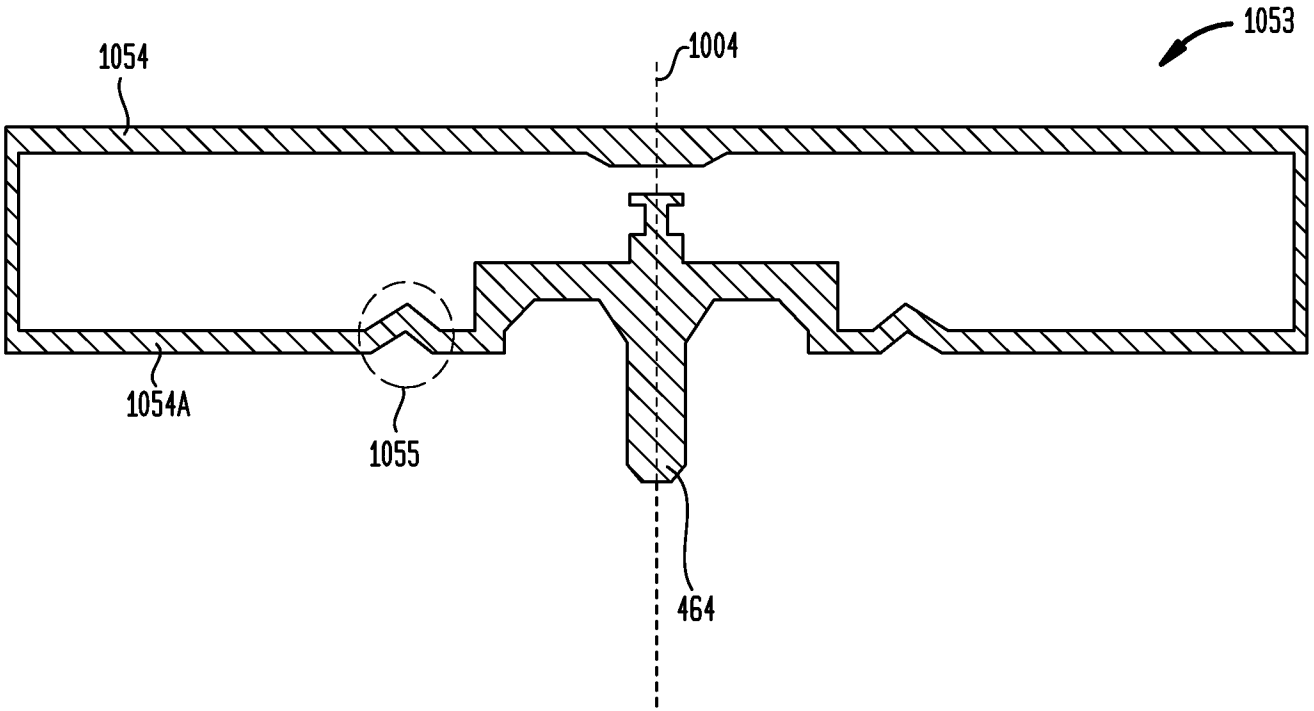
FIG. 10 is a schematic diagram illustrating another exemplary portion of the implantable component of an active transcutaneous bone conduction device according to an embodiment of the present invention.

FIG. 10 depicts another alternate embodiment of a vibratory apparatus 1053 including a housing 1054 having an integral vibration isolator located within dashed lines 1055. In the embodiment of FIG. 10, the vibration isolator 1055 is made of the same material as that of the housing 1054 on either side of the vibration isolator 1055 or the entire housing 1054. The vibration isolator 1055 corresponds to a portion of bottom housing wall 1054A that has a shape that achieves the vibration isolation characteristics detailed herein and variations thereof. In an exemplary embodiment, this shape may be a housing wall having a corrugated cross section (wave shaped, zigzag shaped, a combination thereof, etc.). In the exemplary embodiment depicted in FIG. 10, this corresponds to a portion of bottom housing wall 1054A that has substantial surface tangent deviations relative to surface tangents of that of another portion of bottom housing wall 1054A proximate the vibration isolator 1055. It is noted that in the embodiment of FIG. 10, the thickness of the housing wall, as measured in a direction normal to the surface tangent (hereinafter, with reference to the embodiment of FIG. 10, referred to as the "tangent thickness") of the vibratory isolator 1055 is substantially the same over the span of the vibration isolator 1055 and is also the same as the tangent thickness of portions of the bottom housing wall 1054A on one or both sides of the vibratory isolator 1055.

In an exemplary embodiment, the surface tangent may vary from plus or minus about 2 degrees, about 4 degrees, about 6 degrees, about 8 degrees, about 10 degrees, about 15 degrees, about 20 degrees, about 25 degrees, about 30 degrees, about 35 degrees about 40 degrees, about 45 degrees, about 50 degrees, about 60 degrees, about 70 degrees, about 80 degrees or about 90 degrees relative to a plane normal to the longitudinal axis 1004, or about any angle in between any of these angles, in 1 degree increments or about 1 degree increments. Also, the number of tangent inflections relative to the plane normal to the longitudinal axis 1004 may be about 1, about 2, about 3, about 4, about 5, about 6, about 7, about 8, about 9 or about 10 or more.

While the embodiment of FIG. 10 is depicted as having surface tangents on the top of the vibration isolator 1055 that are parallel to those at corresponding locations on the bottom of the vibration isolator 1055, in other embodiments, the surface tangents on the top may have different angles with respect to those at corresponding locations on the bottom relative to the plane normal to the longitudinal axis 1004. Indeed, in some embodiments, a surface tangent on top may have a positive inclination relative to the plane normal to longitudinal axis 1004, while a surface tangent on the bottom may have a negative inclination relative to the plane normal to the longitudinal axis 1004. Any material shaping that will enable the vibration isolation characteristics detailed herein and/or variations thereof to be achieve may be used in some embodiments.

Some embodiments include a combination of two or more of the structural characteristics of the vibration isolators detailed herein. For example, an exemplary embodiment may include a vibration isolator having different materials and having a different thickness than other portions of the housing wall as detailed herein. For example, an exemplary embodiment may include a vibration isolator having different materials than other portions of the housing wall as detailed herein and having surface tangent variations as detailed herein. For example, an exemplary embodiment may include a vibration isolator having different thicknesses than other portions of the housing wall as detailed herein and having surface tangent variations as detailed herein. Still further by example, an exemplary embodiment may include a vibration isolator having different thicknesses and different materials than other portions of the housing wall as detailed herein and having surface tangent variations as detailed herein.

It is further noted that some or all of the embodiments utilizing the integral vibration isolator detailed herein and variations thereof may be combined with some or all of the embodiments utilizing the rigidly adhered screw portion detailed herein and variations thereof. Also, it is noted that while the embodiments of FIGS. 8-10 have been presented in terms of an active transcutaneous bone conduction device, some or all of the features of those embodiments may be utilized in a passive transcutaneous bone conduction device. In this regard, an exemplary embodiment may include a housing 854 in which a vibrational element such as a ferromagnetic plate is located in lieu of the vibrating actuator 452, the plate vibrating in a manner consistent with the embodiment of FIG. 3, except the plate is hermetically contained in a housing as opposed to being exposed to the body environment.

Figure 11:
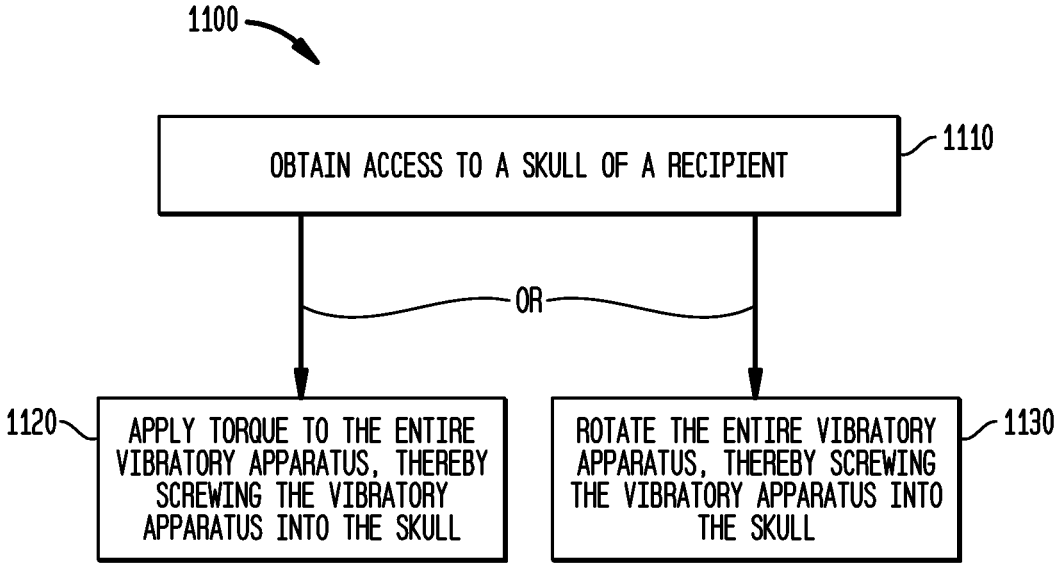
FIG. 11 is a flow chart associated with an exemplary embodiment of the present invention.

An embodiment includes a method of implanting a vibratory apparatus 453. With reference to the flow chart of FIG. 11, method 1100 includes action 1110 entailing obtaining access to a skull of a recipient in which a screw portion of a vibratory apparatus may be received. This may be a skull having a bone fixture therein, or may be a skull having a hole which directly interfaces with the screw portion. Method 1100 includes action 1120 entailing applying a torque to the entire vibratory apparatus, thereby screwing the vibratory apparatus into the skull. Method action 1120 may be substituted for method action 1130, entailing rotating the entire vibratory apparatus, thereby screwing the vibratory apparatus into the skull. In some embodiments, method action 1120 results in method action 1130.

As seen above, vibration isolators may be used to limit and/or prevent transfer of vibrational energy into portions of the housing. In the same vein, in some embodiments, because the screw portion does not extend completely through the housing 854, 954, 1054, or 454, vibrational energy conducted to a top of the respective housing is also limited relative to a configuration in which the screw portion so extended.

While various embodiments of the present invention have been described above, it should be understood that they have been presented by way of example only, and not limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the following claims and their equivalents.

What is claimed is:

1. A hearing prosthesis, comprising:

an implantable component including a vibratory portion configured to vibrate in response to a sound signal and a coupling portion configured to removably attach the implantable component to a recipient of the hearing prosthesis, wherein the vibratory portion is rigidly adhered to the coupling portion, and at least one of:

(i) one or more feedthroughs located on the implantable component, and wherein the hearing prosthesis is an active transcutaneous bone conduction device, and wherein the vibratory portion is a vibrator of the active transcutaneous bone conduction device that receives a signal through the one or more feedthroughs; or (ii) the hearing prosthesis is a passive transcutaneous bone conduction device, and the implantable component is an implantable component of the passive transcutaneous bone conduction device.

2. The hearing prosthesis of claim 1, wherein:

an exterior surface area of the implantable component that encompasses at least a portion of a surface of the vibratory portion and at least a portion of a surface of the coupling portion is gapless.

3. The hearing prosthesis of claim 1, wherein:

an exterior surface area of the implantable component that encompasses at least a portion of a surface of the vibratory portion and at least a portion of a surface of the coupling portion is seamless.

4. The hearing prosthesis of claim 1, comprising:

the one or more feedthroughs located on the implantable component, wherein the hearing prosthesis is the active transcutaneous bone conduction device, and wherein the vibratory portion is the vibrator of the active transcutaneous bone conduction device that receives the signal through the one or more feedthroughs.

5. The hearing prosthesis of claim 1, wherein:

the hearing prosthesis is the passive transcutaneous bone conduction device; and the implantable component is the implantable component of the passive transcutaneous bone conduction device.

6. The hearing prosthesis of claim 5, wherein:

the vibratory portion and the coupling portion collectively form a monolithic component of the implantable component.

7. The hearing prosthesis of claim 1, wherein:

the hearing prosthesis is configured to conduct vibrations from the vibratory portion to an outer surface of the hearing prosthesis and from there into tissue of the recipient to evoke a bone conduction hearing percept via the conducted vibrations.

8. The hearing prosthesis of claim 1, wherein a portion of the vibratory portion is configured to move relative to the coupling portion.

9. The hearing prosthesis of claim 1, wherein the hearing prosthesis is the passive transcutaneous bone conduction device.

10. A hearing prosthesis, comprising:

a vibrational element; and a housing containing the vibrational element, the housing including an integral vibration isolator; wherein the vibrational element is connected to the housing at a first location; and the hearing prosthesis is configured such that the integral vibration isolator isolates a first portion of the housing from vibrations generated by the vibrational element, wherein the first portion of the housing is located, relative to a path along the housing extending from the first location to the vibration isolator to the first portion, with the vibration isolator being in between the first location and the first portion, after the vibration isolator.

11. The hearing prosthesis of claim 10, wherein:

the integral vibration isolator comprises a first wall section of housing wall of the housing that has a thinner wall thickness than that of a second wall section of housing wall proximate the first section of housing wall.

12. The hearing prosthesis of claim 10, wherein:

the integral vibration isolator comprises a first wall section of housing wall of the housing that comprises, in substantial amounts, a different material than that of a second wall section of housing wall proximate the first section of housing wall.

13. The hearing prosthesis of claim 10, wherein:

the integral vibration isolator comprises a first section of housing wall having a corrugated cross-section.

14. The hearing prosthesis of claim 10, wherein:

the integral vibration isolator comprises a first section of housing wall of the housing that has substantial surface tangent deviations relative to surface tangents of that of a second section of housing wall proximate the first section of housing wall.

15. The hearing prosthesis of claim 10, wherein:

the housing includes a bottom housing wall at least a portion of which is configured to interface with bone and having a direction of radial extension away from a center of the housing; and the bottom housing wall has at least one first surface tangent deviation and one second surface tangent deviation inverse of the first surface tangent deviation, wherein the first and second surface deviations are substantial deviations from a plane extending in the direction of radial extension.

16. The hearing prosthesis of claim 10, comprising:

a bone fixture screw configured to screw into a bone fixture osseointegrated into a recipient of the hearing prosthesis, wherein the vibrational element is vibrationally connected to the bone fixture screw.

17. The hearing prosthesis of claim 16, wherein:

the housing includes a bone fixture interface sub-portion; and wherein the integral vibration isolator is a sub-portion of the housing proximate the bone fixture interface sub-portion.

18. The hearing prosthesis of claim 16, wherein:

the integral vibration isolator is proximate the bone fixture screw.

19. The hearing prosthesis of claim 10, wherein:

the integral vibration isolator is configured to have poor acoustic transmission therethrough relative to that of the housing inboard of the vibration isolator.

20. The hearing prosthesis of claim 10, wherein:

the housing includes a bottom housing wall configured to interface with bone of a recipient; and the integral vibration isolator is configured to channel substantially all mechanical vibrations generated by the vibrational element and conducted to the housing through an area no more than about 25% of a bottom area of the housing.

21. The hearing prosthesis of claim 10, wherein:

the housing includes a bottom configured to interface with bone of a recipient; and the integral vibration isolator is configured to channel substantially all mechanical vibrations generated by the vibrational element and conducted to the housing to the recipient through an area no more than about 25% of an area of the bottom of the housing configured to interface with bone of the recipient.

22. The hearing prosthesis of claim 10, wherein:

the housing is an implantable component of a transcutaneous bone conduction device configured to transfer vibrations to bone of a recipient to evoke a hearing percept; and the hearing prosthesis is configured such that all vibrations transferred to the bone of the recipient to evoke a hearing percept are first transferred into the mastoid bone through the housing at a location where the housing is fixed relative to the mastoid bone.

23. The hearing prosthesis of claim 10, wherein:

the integral vibration isolator is integral with the housing;

the vibrational element is enveloped by the housing;

the integral vibration isolator forms a wall section of the housing; and the housing is configured such that the volume of the housing remains constant during movement of the vibrational element.

24. The hearing prosthesis of claim 10, wherein:

the integral vibration isolator prevents vibrations that have entered a second portion of the housing from the vibratory element as a result of the vibratory element moving relative to the housing from reaching a third portion of the housing, wherein the second and third portions of the housing are fixed relative to one another.

25. A method, the method comprising:

generating vibrational energy indicative of a sound signal with a hearing prosthesis;

conducting the vibrational energy to a recipient of the hearing prosthesis via a vibrational path through the hearing prosthesis; and minimizing conduction of the vibrational energy to the recipient via another vibrational path through the hearing prosthesis; wherein the paths are separate parallel paths that lead to tissue of the recipient.

26. The method of claim 25, wherein the action of minimizing comprises:

maintaining a substantial acoustic impedance mismatch between structures of the hearing prosthesis.

27. The method of claim 25, wherein:

the hearing prosthesis is a transcutaneous bone conduction device.

* * * * *